US005408444A

United States Patent [19]

Kita et al.

[11] Patent Number: 5,408,444

[45] Date of Patent: Apr. 18, 1995

[54] ELECTRONIC TIMEPIECE CAPABLE OF RECEIVING SIGNALS FROM SATELLITES

[75] Inventors: Kazunori Kita, Mizuhomachi; Satoshi Kinoshita, Hamura, both of Japan

[73] Assignee: Casio Computer Co., Ltd., Tokyo, Japan

[21] Appl. No.: 899,254

[22] Filed: Jun. 16, 1992

[30] Foreign Application Priority Data

Jun. 19, 1991 [JP] Japan ..... 3-147669
Jun. 19, 1991 [JP] Japan ..... 3-147670

[51] Int. Cl.[6] ..... G04C 11/02
[52] U.S. Cl. ..... 368/47
[58] Field of Search ..... 368/10, 46, 47; 343/225; 455/12, 51

[56] References Cited

U.S. PATENT DOCUMENTS

| | | | |
|---|---|---|---|
| 4,287,597 | 9/1981 | Paynter et al. | 455/12 |
| 4,494,211 | 1/1985 | Schwartz | 368/47 |
| 4,744,083 | 5/1988 | O'Neill et al. | 371/22 |
| 5,208,790 | 5/1993 | Sato | 368/15 |

FOREIGN PATENT DOCUMENTS

| | | | |
|---|---|---|---|
| 63-0118687 | 5/1988 | Japan | 368/47 |
| 63-250584 | 10/1988 | Japan | 368/47 |
| 3-61893 | 3/1991 | Japan | 368/47 |

*Primary Examiner*—Vit W. Miska
*Attorney, Agent, or Firm*—Frishauf, Holtz, Goodman & Woodward

[57] ABSTRACT

In an electronic timepiece having a signal receiving function, the present time at a place where a user is located can be displayed without designating a regional name. The quasi-distance data between the satellites and the signal receiving point is calculated based upon the delay times of the signals transmitted from the satellites. The positional information about the signal receiving point is obtained from four quasi-distance data. Subsequently, this positional information is compared with the longitude/latitude data previously stored in ROM, to search a city located nearest this signal receiving point. Furthermore, a judgement is made whether or not the city located nearest the present receiving point is coincident with the city located nearest the preceding receiving point. If these cities are coincident with each other, then the present time of the city stored in the time counting register is directly displayed. If no coincidence is established, then the time counted by the time counting unit is corrected based upon the time difference data about the city located nearest the present signal receiving point, and also the corrected time is displayed in combination with the name of this city.

24 Claims, 6 Drawing Sheets

| | | | |
|---|---|---|---|
| BANGKOK | +07 | E101° | +14° |
| HONG KONG | +08 | E114° | +22° |
| TOKYO | +09 | E140° | +36° |
| ADELAIDE | +9.5 | E139° | -35° |

TOKYO
SUN 6-12
PM 12:56 56

FIG.7A

TOKYO
22.5
265

FIG.7D

HONG KONG
SUN 6-12
AM 11:56 56

FIG.7B

TOKYO
LO. +38
LA. E142

FIG.7E

TOKYO
AM
5:25 6-12
PM 7:35

FIG.7C

ELECTRONIC TIMEPIECE CAPABLE OF RECEIVING SIGNALS FROM SATELLITES

BACKGROUND OF THE INVENTION

1. Field of the Invention

The present invention relates to an electronic timepiece having a function to receive various signals transmitted from an artificial satellite, and capable of displaying time at an arbitrary point on a map. More specifically, the present invention is directed to a wrist watch and a compact electronic appliance equipped with a timepiece, which are capable of receiving signals from satellites and of displaying various temporal data.

2. Description of Prior Art

Conventionally, a so-called "world clock" has been marketed into which data on time differences related to plural cities in the world have been previously stored. Upon instruction of names of cities, present times of the designated cities are displayed in this world clock. Furthermore, the electronic timepieces have been proposed which can display times of sunrise, sunset, and age of the moon by putting positional information of a certain city in the world, for instance, longitude and latitude.

Very recently, there are many possibilities that travelers move within a short time among plural regions where there are time differences, due to great progress in transportation. In this case, when the travelers wish to know times at the respective points on a map, they should select the names of cities by manipulating switches to display time of this city. There is a problem that such a cumbersome operation is required.

Also, every time times on sunrise, sunset, and age of the moon at the respective points on the world map are desired, the positional information about the respective points should be inputted, resulting in cumbersome operations.

SUMMARY OF THE INVENTION

The present invention has been made in an attempt to solve the above described problems, and therefore, has an object to provide an electronic timepiece having a signal receiving function and capable of displaying present time at a point on a map without designating a region where a user is located.

Another object of the present invention is to provide an electronic timepiece having a signal receiving function and capable of displaying data about sunrise, sunset and age of the moon with regard to a present position where a user is located without inputting positional information on the present position.

To achieve these objects, an electronic timepiece with a signal receiving function, according to the present invention, comprises:

time counting means for counting time information;

regional information storing means for storing regional information about a region having the time information counted by the time counting means as present time;

receiving means for receiving a signal transmitted from a satellite;

receiving-position calculating means for calculating positional information about a receiving position based on the signal obtained from the receiving means; and time controlling means for obtaining time information of the receiving point from the positional information calculated by the receiving-position calculating means, the regional information stored in the regional information storing means, and the present time information counted by the time counting means.

With the above-described arrangements, in accordance with the electronic timepiece according to the present invention, the positional information about the present position is calculated by receiving the signal transmitted from the satellite, and the correct time of the present position may be continuously displayed based on the positional information without designating the region by a user. Furthermore, the time data with high precision may be obtained by correcting the time under the time counting operation in response to the world standard time data sent from the satellite.

BRIEF DESCRIPTION OF THE DRAWINGS

For a better understanding of the present invention, reference is made of the following detailed description with reference to the accompanying drawings, in which:

FIGS. 7A to 7E are display condition diagrams for the electronic wrist watch of FIG. 1.

DETAILED DESCRIPTION OF THE PREFERRED EMBODIMENTS

Figure 1:
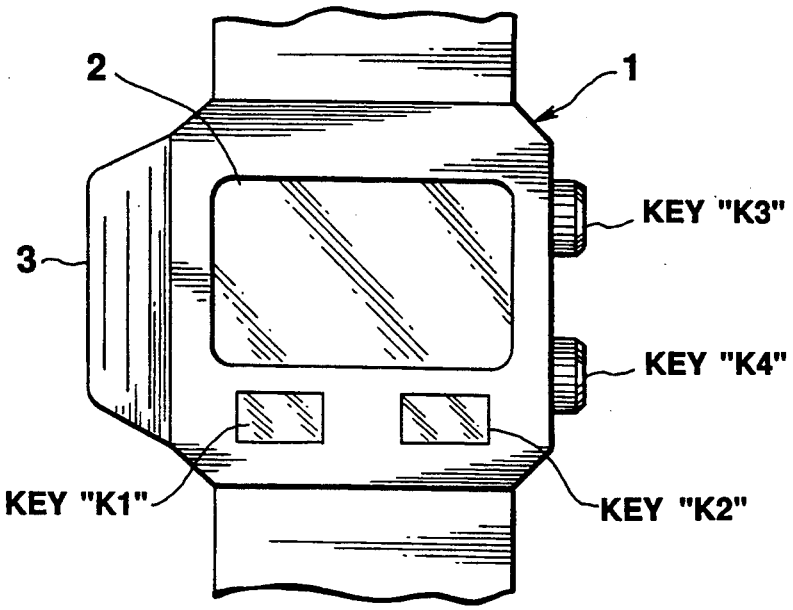
FIG. 1 is an outer view of an electronic wrist watch according to a preferred embodiment of the present invention.

Referring now to drawings, an electronic wrist watch according to a first preferred embodiment of the present invention will be described. FIG. 1 is an outer view of the electronic wrist watch according to the first preferred embodiment. The first electronic wrist watch has a function to receive a radio signal transmitted from the satellites used in the GPS (Global Positioning System) system.

In the GPS system, a calculation is made between the satellites and the receiving position (receiver) based on the time required for the radio signals transmitted from the satellites to arrive at the receiver, and the position of the cross point of the lines drawn from a plurality of satellites is obtained as the present position.

To calculate the delay times of the signals transmitted from the satellites, the receiver requires the timepiece having the same precision as that of the timepieces employed in the satellites and synchronized with these timepieces. In case an atomic clock such as cesium and rubidium has been installed within the receiver, which is the same type of clock of the satellite, the correct position of the receiving point of the receiver can be calculated based upon the signals transmitted from three satellites. On the other hand if a compact and low-cost receiver is required, since such an atomic clock having the same precision as that of the satellite cannot be built in the receiver, the correct receiving position of this receiver may be recognized by calculating the distances measured from 4 pieces of satellites in order to cancel the errors occurring in the time measurements.

OVERALL ARRANGEMENT OF FIRST ELECTRONIC WRIST WATCH

In the overall arrangement of the electronic wrist watch according to the first preferred embodiment of the present invention, a dot matrix display unit 2 is provided at a center of a main body 1 of this wrist watch, which displays both of the time of an arbitrary city in the world and positional information consisting of longitude and latitude of the receiving point. Under the main body 1, there are provided a key "K1" for designating signal receptions from the satellites, and a key "K2" manipulated to display sunrise time and sunset time.

Also, on a right side of the main body 1, there are provided a key "K3" manipulated when a moon age and a moon phase are displayed, and also a key "K4" operated when present time is adjusted.

Furthermore, an antenna storage unit 3 for storing a microstrip antenna (not shown in detail) and the like so as to receive the radio signals transmitted from the satellites, is provided at a left side of the main body 1.

Figure 2:
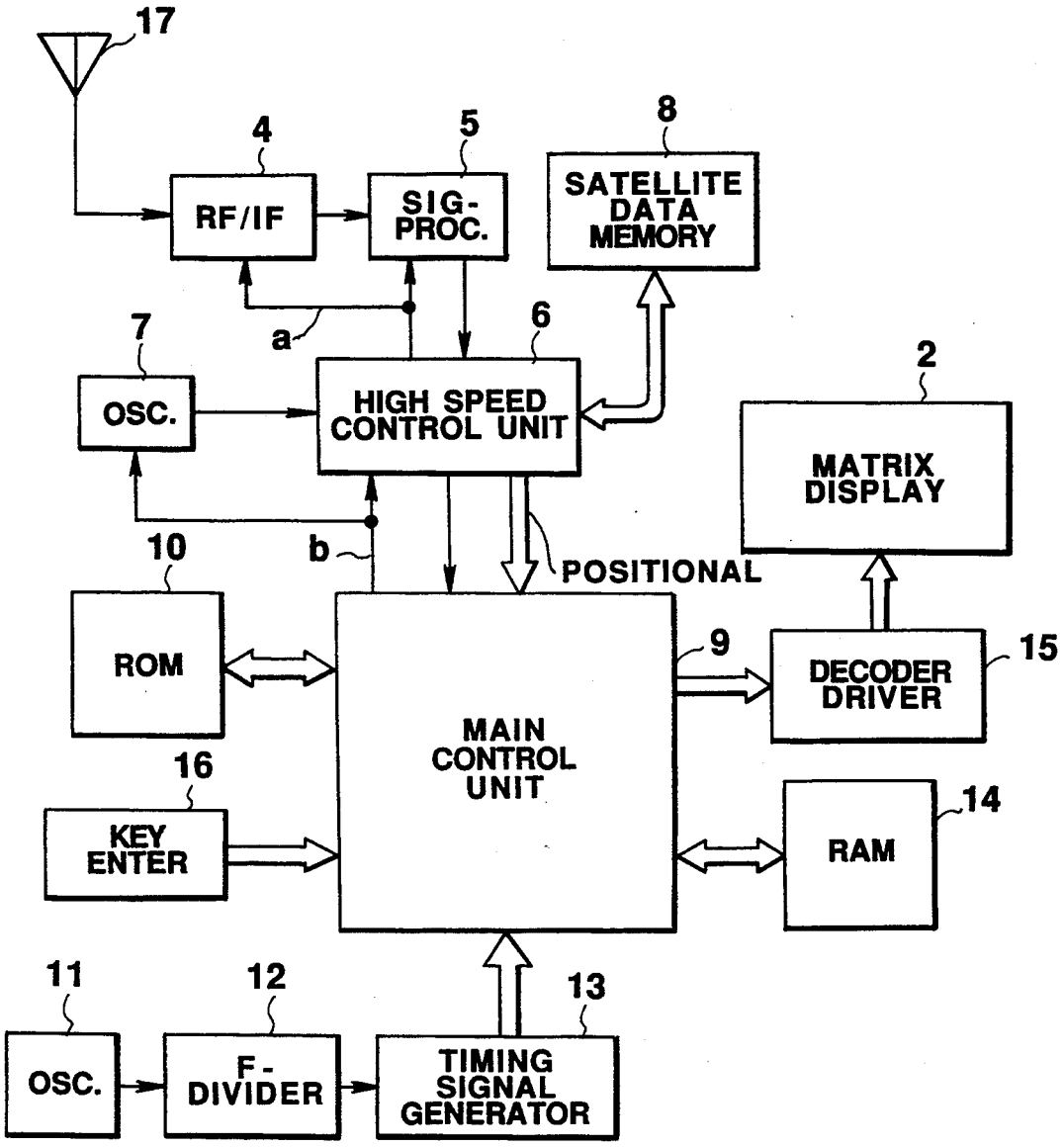
FIG. 2 is a circuit block diagram of the electronic wrist watch shown in FIG. 1.

In FIG. 2, there is shown a circuit diagram of the first electronic wrist watch. In this circuit diagram, the radio signal having the frequency of approximately 1.5 GHz which has been transmitted from the satellite of the GPS system, is inputted via an antenna 17 into a radio frequency/intermediate frequency (RF/IF) amplifying unit 4 to be amplified therein and converted into a predetermined IF signal. The RF/IF-processed signal from the RF/IF amplifying unit 4 is supplied to a signal processing unit 5.

The signal processing unit 5 synchronizes this IF signal with a PRN code produced within this receiver, reverse-diffuses the radio signal which has been spectrum-diffused and then transmitted from the satellite, and then obtains quasi-distance data between the satellite and the receiving point from the resultant signal by the reverse diffusion. It should be noted that since the quasi-distance data from 4 satellites are calculated by the signal processing unit 5, the errors contained in the temporal components are corrected. The signal processing unit 5 outputs these quasi-distance data and also messages (correction information about satellite clocks, orbit information, calendar information about satellites etc.) contained in the reception signals to a highspeed control unit 6. Both of the RF/IF amplifying unit 4 and signal processing unit 5 start the operations thereof in response to an operation instruction signal "a" derived from the highspeed control unit 6.

The highspeed control unit 6 is constructed of, for instance, a 16-bit microprocessor, and is driven in response to a highspeed clock signal outputted from an oscillator 7 with high precision (e.g., a cesium oscillating source with high precision). The highspeed control unit 6 judges based upon the orbit information and the like of 24 satellites employed in the GPS system, which has been stored in a satellite data memory 8 which signals from the satellites are receivable at this time, and then instructs the signal processing unit 5 to produce the PRN code of the receivable satellites. Also, the highspeed control unit 6 obtains the positional information about the receiving point based on the quasi-distance data about a plurality of satellites outputted from the signal processing unit 5, and then outputs this positional information to a main control unit 9 (will be described later). It should be noted that both of the highspeed control unit 6 and the oscillator 7 commence their operations when an initiation signal "b" derived from the main control unit 9 becomes "ON", whereas they stop their operations when this initiation signal "b" becomes "OFF".

Another oscillator 11 oscillates a clock signal having a frequency of, e.g., 32,768 KHz which constitutes a reference signal for a time counting operation, and this clock signal oscillated from this oscillation is frequency-divided into a frequency dividing circuit 12, and the frequency-divided clock signal is supplied to a timing signal generating circuit 13. The timing signal generating circuit 13 produces a time-counting signal having a frequency of 16 Hz functioning as the reference signal of the time counting operation from the signal which has been frequency-divided by the frequency diving circuit 12, and then outputs this time-counting signal to the main control unit 9.

A key enter unit 16 is arranged by the above-described keys "K1" to "K4", and outputs key-operation signals to the main control unit 9 in response to the respective key operations.

The main control unit 9 corresponds to a control unit for controlling operations of the entire circuit, and is arranged by a microprocessor. In accordance with a control program stored in ROM 10, a time counting process, a signal reception process and the like are executed in this main control unit 9, these process results are stored in RAM 14, and also the time data and positional information stored in RAM 14 are supplied to a decoder driver 15, thereby being displayed on a dot-matrix display unit 2 under control of the main control unit 9.

REGISTER ARRANGEMENT

Figures 3, 4:
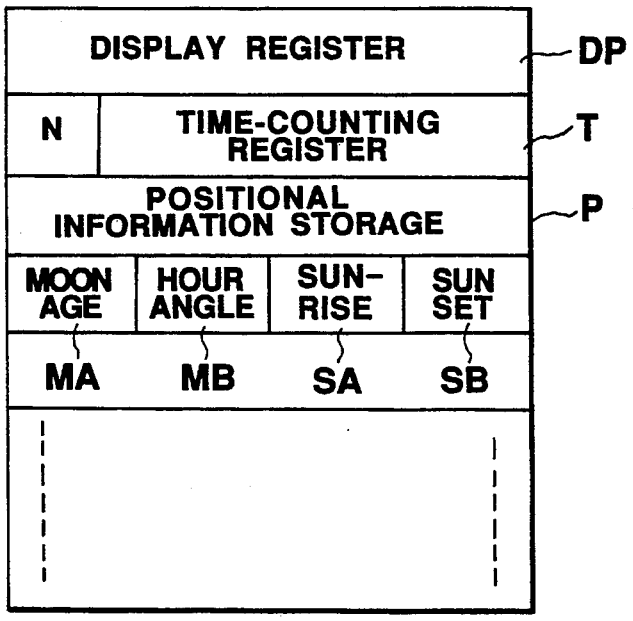
FIG. 3 illustrates an arrangement of a RAM register shown in FIG. 2.
FIG. 4 illustrates an arrangement of ROM shown in FIG. 2.

FIG. 3 schematically represents an arrangement of a register of the above-described RAM 14. In RAM 14, there are provided a city-name counter "N" for storing numeral values corresponding to regional places, for instance, cities; a time-counting register "T" for storing present time of the city designated by this city-name counter "N"; a positional information storage register "P" for storing positional information (longitude, latitude etc.) of the receiving point calculated by the highspeed control unit 6; a moon-age register "MA" for storing an age of the moon which will be calculated by a moon-age calculation; an hour-angle register "MB" for storing an hour angle which will be calculated by an hour-angle calculation; a sunrise time register "SA" for storing sunrise time which will be calculated by a sunrise time calculation; and a sunset time register "SB" for storing sunset time which will be calculated by a sunset time calculation.

Also, a display register "DP" for storing data to be displayed on the dot-matrix display unit 2 is provided in this RAM 14.

Furthermore, FIG. 4 schematically represents a content of ROM 10 in which various data on time differences, longitude, and latitude about a plurality of cities in the world have been fixedly stored.

That is, the data on the time differences of a large number of cities in the world with reference to world standard time (namely, Greenwich Mean Time), the data on the longitude thereof, and the data on the latitude thereof have been previously stored in ROM 10. For instance, at the position of BANGKOK in this ROM 10, +(plus) 7 hours have been stored as the time difference of BANGKOK with respect to Greenwich Mean Time; and the east longitude of 114×/the north latitude of 14× have been stored as the positional data of BANGKOK. The city-name counter "N" designates the data storage positions of ROM 10, and the numeral values of the city-name counter "N" correspond to the names of the cities in the world in a 1-to-1 correspondence.

OVERALL OPERATION OF FIRST ELECTRONIC WRIST WATCH

Referring now a flow chart of FIG. 5, an overall operation of the electronic wrist watch shown in FIGS. 1 to 4 will be described.

Figure 5:
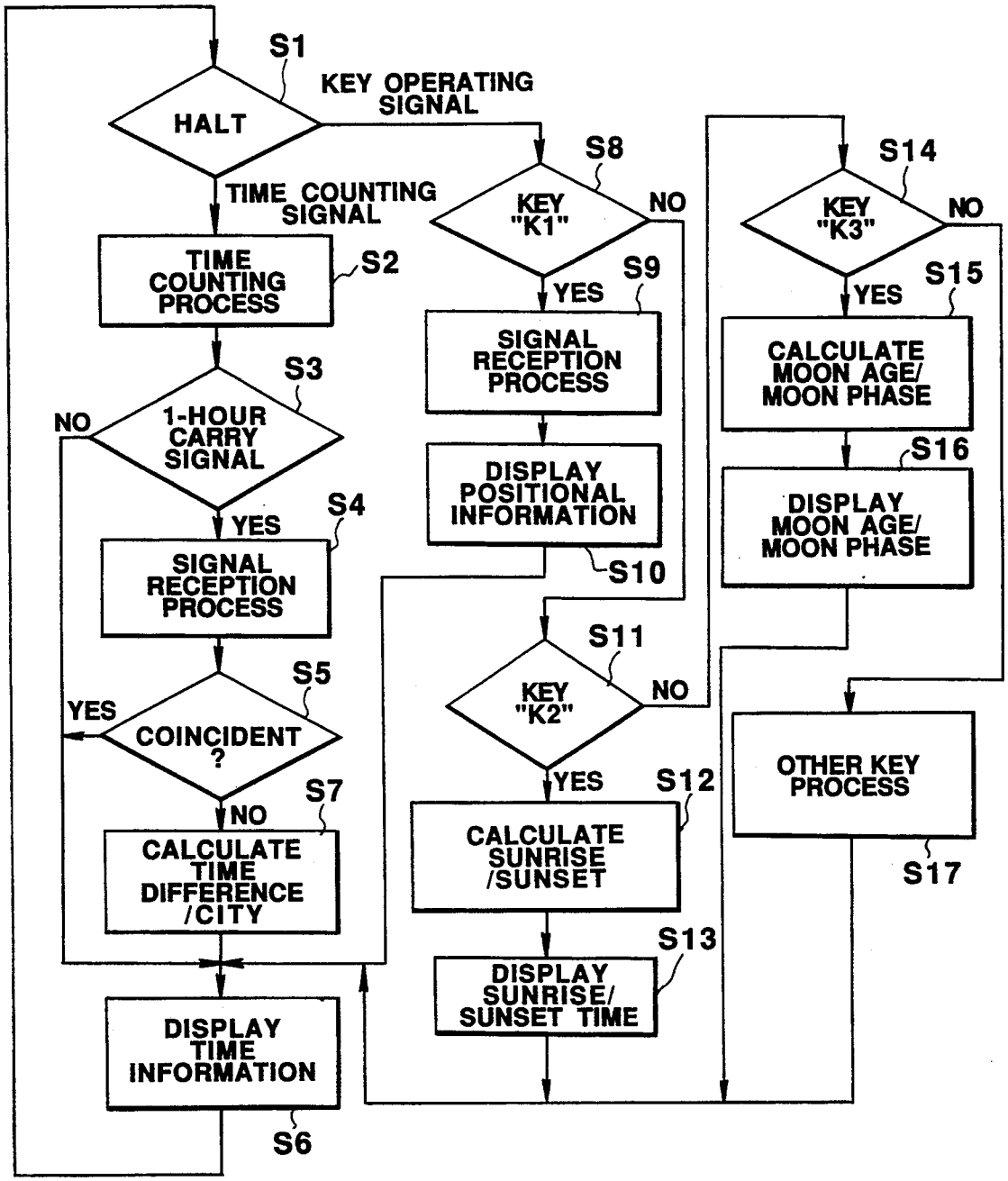
FIG. 5 is a flow chart for explaining an operation of the circuit shown in FIG. 2.

Normally, the main control unit 9 is under a halt state at a step S1 of the flow chart shown in FIG. 5. Upon receipt of the time-counting signal of 16 Hz, a time-counting process as defined at a step S2 is executed by this main control unit 9, whereas upon receipt of the key operation signal, a key process operation defined after a step S8 is carried out by the main control unit 9.

In the time-counting process defined at the step S2, a judgement is made whether or not a second carry signal, a minute carry signal, an hour carry signal and the like have been produced in response to the time count signal. When these carry signals are produced, the time data stored in the time-count register "T" of RAM 14 is updated.

At a next step S3, a check is made whether or not a 1 hour carry signal is produced. If the 1 hour carry signal is produced, then a signal reception process defined at a step S4 is initiated, and then the initiating signal "b" is outputted from the main control unit 9, so that the reception of the radio signals from the satellites is commenced.

DETAILED OPERATION OF SIGNAL RECEPTION

Figure 6:
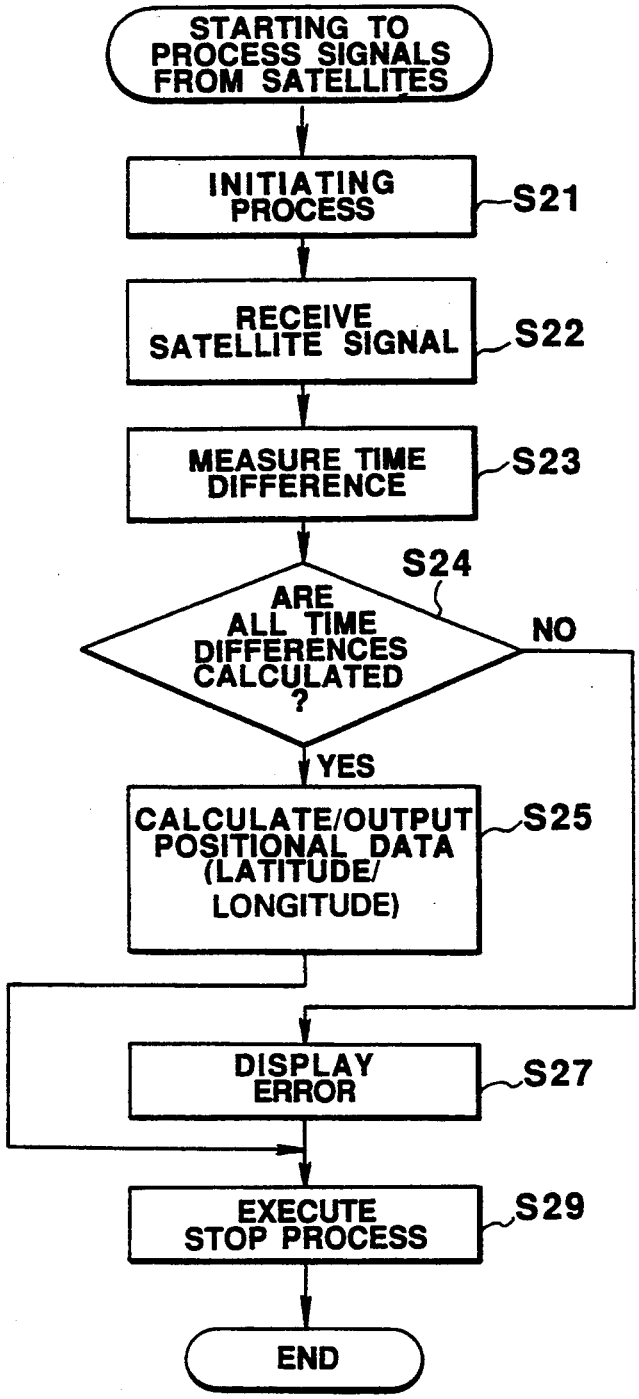
FIG. 6 is a flow chart for explaining a detailed operation of the signal receiving process shown in FIG. 5.

A detailed operation of the above-described signal reception process defined at the step S4 of FIG. 5 will now be explained with reference to a flow chart shown in FIG. 6. In an initiating process at a step S21 of FIG. 6, the main control unit 9 sets the initiation signal "b" to ON, and therefore commences the operations of the oscillator 7 and the highspeed control unit 6.

At a subsequent step S22, the highspeed control unit 6 sets the operation instructing signal "a" to ON, and thereof operates both of the RF/IF amplifying unit 4 and the signal processing unit 5 in order to start the satellite signal reception.

In a time-difference measuring process of a step S23, the signal processing unit 5 calculates the delay time of the signal transmitted from the satellite, and also calculates the distance between the relevant satellite and the receiving point based upon this delay time. Thereafter, a check is done whether or not all of the distances measured from the four satellites have been calculated at a step S24.

When the signals transmitted from the four satellites can be normally received and all of the distances between these satellites and the receiving point could be already measured, the highspeed control unit 6 calculates the positional information of the receiving point such as the latitude and the longitude based on these distance data, and outputs this positional information to the main control unit 9 at a step S25.

As a result of the previous process steps, since the positional information about the receiving point of the satellite signals could be obtained, the highspeed control unit 6 sets the operation instructing signal "a" to OFF, and stops the operations of the RF/IF amplifying unit 4 and the signal processing unit 5, and furthermore announces the completion of this signal reception process to the main control unit 9 at a step S29. Upon receipt of this announce signal, the main control unit 9 sets the initiating signal "b" to OFF, so that the operations of the oscillator 7 and the highspeed control unit 6 are stopped, and then the signal reception process is accomplished.

On the other hand, if the signals transmitted from the four satellites could not be received at the judging step S24, then an occurrence of an error is reported by the highspeed control unit 6 to the main control unit 9 at a step S27. Upon receipt of this error occurrence report, the dot-matrix display unit 2 displays "error" thereon under control of this main control unit 9, and thereafter the operations of the highspeed control unit 6 are interrupted at the next step S29.

Upon completion of satellite signal reception, the overall process is advanced to a further step S5 shown in FIG. 5. At this step S5, the main control unit 9 compares the positional information about the signal receiving point which has been calculated by the highspeed control unit 6 with the longitude/latitude data on the respective cities in the world which have been previously stored in ROM 10 so as to search the city corresponding to this signal receiving point, for instance, the city which is very close to the signal receiving point. At this time, since the numeral values indicative of the closest city for the previous signal receiving point (will be simply referred to as "a city name") has been set in the city-name counter "N" of RAM 14, a check is made whether or not the city name stored in this city name counter "N" is coincident with the city name obtained from the present positional information.

If there is a coincidence between these city names, then the process is advanced to a step S6. At this step S6, the time data stored in the time counting register "T" is displayed on the dot-matrix display unit 2 in conjunction with the city name designated by the city-name counter "N" at this time.

FIG. 7A is one example of this display condition. As represented in FIG. 7A, in this preferred embodiment, the name of city "TOKYO" as the closest city for the signal receiving point, and also the present time of Tokyo "June 12, PM 12:56, 56" are displayed by processing the positional information about the signal receiving point.

It should be noted that when the longitude/latitude data on the respective cities with allowable ranges, for instance, "HONG KONG E108x to E127x" have been stored in ROM 10, a check is made whether the positional information of the receiving point belongs to this allowable range of the longitude/latitude data on this city "Hong Kong", so that the closest city for this signal receiving point may be determined.

On the other hand, when there is no coincidence between the names of cities at the previous step S5, this implies that as a result of movement by a user who holds this electronic wrist watch, the closest city to the present signal receiving point is different from the closest city to the preceding signal receiving point. In this case, the process is advanced to a step S7 at which after the name of the closest city to the present receiving point has been set to the city-name counter "N", the time data of the time counting register "T" is corrected based on the time difference data between the previous city and the city newly set in the city-name counter "N", and the corrected time is changed into the time at the receiving point, so that this time and the name of city are displayed on the dot matrix display unit 2.

As a consequence, when the user is moved from "Tokyo" to "Hong Kong", as illustrated in FIGS. 7A and 7B, the time of the destination city, i.e., Hong Kong is automatically displayed.

Returning back to the previous step S1 of FIG. 5, when the main control unit 9 is under "Halt" state and detects the key operation signal, the process is advanced to a step S8. At this step S8, a check is done whether or not the key "k1" has been first manipulated.

When the key "K1" is operated, this process is advanced to a Step S9 at which a signal reception process similar to that of the preceding step S4 is executed so that the distance measured from the satellites is calculated and the positional information about the signal receiving point.

Subsequently, the positional information about this signal receiving point is displayed at a next step S10 on the dot matrix display unit 2.

This positional information is displayed under such a display state shown in FIG. 7E. That is, the name of "Tokyo" is the closest city to this signal receiving point, the longitude of "North 38×" of this receiving point, and the latitude of "East 142×" thereof are displayed.

In other words, both of the name of the closest city for the signal receiving point and the positional information thereof can be displayed by operating the key "K1" by the user.

If the judgement at the step S8 is made that the manipulated key does not correspond to the key "K1", the process is advanced to a step S11 at which another check is made whether or not the key "K2" is operated.

If the key "K2" is manipulated, then the process is advanced to a step S12. At this step S12, a calculation is performed to obtain the times of sunrise and sunset at this receiving point on that day based on both of the positional information about this receiving point and the time data stored in the time counting register "7", and thereafter these calculated time data are stored into the sunrise/sunset time registers SA and SB, respectively. Furthermore, these sunrise/sunset times are displayed on the dot-matrix display unit 2 at a step S13. It should be noted that the sunrise/sunset time calculating methods with employment of the positional information and the data information have been described in, for instance, the co-pending U.S. patent application Ser. No. 528,947, filed on May 24, 1990, by the same assignee, Casio Computer Company.

In FIG. 7C, there are shown the sunrise/sunset times and the day. On the dot-matrix display unit 2, there are displayed "Tokyo" which is located nearest the signal receiving point, "AM 5:25" corresponding to the sunrise time on June 12 at this signal receiving point, and "PM 7:35" corresponding to the sunset-time on that day.

That is, the name of the city located nearest the signal receiving point, the sunrise time and the sunset time of the signal receiving point can be recognized by manipulating the key "K2". It should be noted the sunrise/sunset times are displayed for the nearest city, i.e., "Tokyo" instead of the signal receiving point.

To the contrary, if the manipulated key dose not correspond to the key "K2" at the step S11 of FIG. 5, the process is advanced to a step S14 at which a judgement is made whether or not the key "K3" is operated.

When the manipulated key corresponds to the key "K3", the process is advanced to a next step S15 at which both of a moon age and a moon phase at the signal receiving point are calculated based on the positional data thereof and also the time data stored in the time counting register "T" in accordance with the above-described co-pending U.S. patent application. Accordingly, the moon age data and the moon hour-angle data are stored in the moon age register "MA" and the hour angle register "MR" of RAM 14 respectively. At the next step S16, these moon age data and moon hour-angle dots are displayed on the dot-matrix display unit 2.

FIG. 7D represents this data display mode such that the name of city "Tokyo" located nearest the signal receiving point, the moon age "22.5" at the signal receiving point, and also the moon elongation "265×" are displayed on the dot-matrix display unit 2.

In other words, the user can recognize the name of city located nearest the signal receiving point, the moon age of this signal receiving point, and the moon hour-angle data thereof.

If the key "K3" is not operated at the judging step S14 of FIG. 5, the key "K4" is operated. In this case, the process is advanced to a step S17 at which the time adjustment operation is carried out.

It should be understood that when a predetermined time period has passed under such display conditions of the positional information, sunrise/sunset times, or moon age/moon phase data, the time information display process as defined at the step S6 is executed, so that the present time at this signal receiving point is newly displayed.

As previously described, in accordance with the electronic wrist watch of the first preferred embodiment, since the positional information about the signal receiving point is obtained by receiving the radio signals transmitted from the satellites in the GPS system, and also the present time of the city corresponding to the GPS signal receiving point is displayed by processing this positional information, the present time, sunrise/sunset times, and also moon age/moon phase of the point or place where the user is located can be continuously displayed without the key operations by the user to designate the name of the city.

MODIFICATIONS

As apparent from the foregoing descriptions, the present invention is not limited to the above-described preferred embodiments, but may be modified, changed, and substituted without departing from the technical scope and spirit of the present invention.

For instance, the present time of the city is calculated at the step S7 of FIG. 5 by correcting the present time counted by the register "T" employed in the first electronic wrist watch by only the time difference of this city. Alternatively, since the time data on the world standard time is transmitted from the GPS satellite, a time difference between this world standard time and the corresponding city is added and the time required for performing this process is corrected, so that the present time measured at this city may be obtained. In this case, since the counted times can be precisely corrected based on the highly precise time data derived from the atomic clock such as a cesium clock employed inside the satellite every time the GPS signals are received, the more correct time than that of the first preferred embodiment may be counted so that the time correction in a second unit is no longer required.

Also, the previously set present time of the city has been stored in the time counting register "T" and the register "N", and another register for storing the positional information, city information, and time information at the receiving point may be employed.

Although the positional information is calculated by receiving the GPS signals every 1 hour in the above-described preferred embodiment, these GPS signals may be received at a time interval longer than, or shorter than 1 hour. Alternatively, such a GPS signal reception may be carried out not in a predetermined time interval, but when the specific key is operated.

Furthermore, the above-described preferred embodiment employs two microcomputers, namely the first microcomputer (highspeed control unit 6) used to calculate the positional information about the signal receiving point, and also the microcomputer (main control unit 9) used in the time-count and other control purposes. Alternatively, only a single microcomputer having these two functions may be employed.

Moreover, the present invention is not only applied to the above-described electronic wrist watches, but also to other electronic appliances. For instance, since the navigation apparatuses mounted on ships and vehicles execute the positional detections by the GPS system, the present invention may be applied to these navigation apparatus. In addition, altitude data may be calculated and displayed in combination with the longitude and latitude data.

Also, the time stored in the time counting register "T" is corrected by the present time at the GPS signal receiving position in the above-described preferred embodiment. For instance, a pointer mechanism driven by a step motor may be employed as the time counting means, and then the present time at the GPS signal receiving position may be displayed by rotating the pointer in a quick mode by a distance corresponding to the time difference.

As previously explained, according to the present invention, the positional information about the present point is calculated by receiving the GPS satellite signals, and then the correct time at the present position can be continuously displayed by processing this positional information without designating the region by the user. As the present time is corrected based upon the world standard time data transmitted from the GPS satellites, the time data with high precision can be obtained. Furthermore, the moon data, and the sunrise/-sunset times about an arbitrary point can be recognized without inputting the positional information.

What is claimed is:

1. An electronic timepiece having a signal receiving function, comprising:

time counting means for counting time information;

regional information storing means for storing regional information about a region having the time information counted by the time counting means as present time;

signal receiving means for receiving signals transmitted from a plurality of satellites;

receiving-position calculating means for calculating regional information about a signal receiving point based on the signals received by the signal receiving means;

judging means for judging whether the regional information calculated by the receiving-position calculating means is different from the regional information stored in the regional information storing means; and time controlling means for obtaining time information of the signal receiving point from the regional information calculated by the receiving-position calculating means, the regional information stored in the regional information storing means and the time information counted by the time counting means, when the judging means determines that the regional information calculated by the receiving-position calculating means and the regional information stored in the regional information storing means are different from each other.

2. An electronic timepiece having a signal receiving function as claimed in claim 1, wherein said signal reception by the signal receiving means is performed every time the time information counted by the time counting means has passed a predetermined time period.

3. An electronic timepiece having a signal receiving function as claimed in claim 1, further comprising:

display means for displaying the time information about the signal receiving point obtained by said time controlling means.

4. An electronic timepiece having a signal receiving function as claimed in claim 1, wherein said time controlling means includes:

changing means for changing the time information counted by the time counting means into the time information about the signal receiving point.

5. An electronic timepiece having a signal receiving function as claimed in claim 1, wherein said time controlling means includes:

position/time difference storage means for storing time difference information among regional information about regional points in the world and the world standard time in a relevant relationship, the time difference information being read out from the position/time difference storage means based upon the regional information calculated by said receiving-position calculating means so as to obtain time information about said signal receiving point.

6. An electronic timepiece having a signal receiving function as claimed in claim 5, wherein the regional information stored in said position/time difference storage means corresponds to longitude/latitude data.

7. An electronic timepiece having a signal receiving function as claimed in claim 1, further comprising:

receiving-position information display means for displaying the regional information about the signal receiving point, which has been calculated by said receiving-position calculating means.

8. An electronic timepiece having a signal receiving function as claimed in claim 1, wherein said plurality of satellites are satellites used in the Global Positioning System.

9. An electronic timepiece having a signal receiving function as claimed in claim 1, wherein:

the time counting operation by said time counting means is performed in response to a first clock signal derived from a first oscillating means; and the signal reception by said signal receiving means is executed in response to a clock signal having a frequency higher than that of said first clock signal.

10. An electronic timepiece having a signal receiving function as claimed in claim 1, further comprising:

a first microprocessor means for controlling the time counting operation by said time counting means; and second microprocessor means for controlling the signal reception by said signal receiving means.

11. An electronic timepiece having a signal receiving function, comprising:

time counting means for counting time information;

regional information storing means for storing regional information about a region having the time information counted by the time counting means as present time;

signal receiving means for receiving signals transmitted from a plurality of satellites;

receiving-position calculating means for calculating regional information about a signal receiving point based on the signals received by the signal receiving means;

judging means for judging whether the regional information calculated by the receiving-position calculating means is different from the regional information stored in the regional information storing means;

time controlling means for obtaining time information of the signal receiving point from the regional information calculated by the receiving-position calculating means, the regional information stored in the regional information storing means and the time information counted by the time counting means, when the judging means determines that the regional information calculated by the receiving-position calculating means and the regional information stored in the regional information Storing means are different from each other; and moon data calculating means for obtaining data related to the moon based upon the time information of the signal receiving point calculated by said time controlling means.

12. An electronic timepiece having a signal receiving function as claimed in claim 1, wherein said signal reception by the signal receiving means is performed every time the time information counted by the time counting means has passed a predetermined time period.

13. An electronic timepiece having a signal receiving function as claimed in claim 1, further comprising:

display means for displaying the time information about the signal receiving point obtained by said time controlling means.

14. An electronic timepiece having a signal receiving function as claimed in claim 1, further comprising:

moon data display means for optically displaying data related to the moon obtained by said moon data calculating means.

15. An electronic timepiece having a signal receiving function as claimed in claim 14, wherein said data related to the moon corresponds to at least one of moonage data and moon phase data.

16. An electronic timepiece having a signal receiving function as claimed in claim 11, further comprising:

receiving-position information display means for displaying the regional information about the signal receiving point, which has been calculated by said receiving-position calculating means.

17. An electronic timepiece having a signal receiving function as claimed in claim 11, wherein said plurality of satellites are satellites used in the Global Positioning System.

18. An electronic timepiece having a signal receiving function as claimed in claim 11, wherein:

the time counting operation by said time counting means is performed in response to a first clock signal derived from a first oscillating means; and the signal reception by said signal receiving means is executed in response to a clock signal having a frequency higher than that of said first clock signal.

19. An electronic timepiece having a signal receiving function, comprising:

time counting means for counting both of date information and time information;

regional information storing means for storing regional information about a region having the date information and the time information as present time, both counted by the time counting means;

signal receiving means for receiving signals transmitted from a plurality of satellites;

receiving-position calculating means for calculating regional information about a signal receiving point based on the signals received by the signal receiving means;

judging means for judging whether the regional information calculated by the receiving-position calculating means is different from the regional information stored in the regional information storing means;

time controlling means for obtaining both of the date information and the time information of the signal receiving point from the regional information calculated by the receiving-position calculating means, the regional information stored in the regional information storing means, and the date information and the time information counted by the time counting means, when the judging means determines that the regional information calculated by the receiving-position calculating means and the regional information stored in the regional information storing means are different from each other;

sunrise/sunset time data calculating means for calculating time information about the sunrise and sunset based upon the date information at the signal receiving point calculated by said time controlling means; and sunrise/sunset time display means for displaying the time information about the sunrise and sunset calculated by said sunrise/sunset time data calculating means.

20. An electronic timepiece having a signal receiving function as claimed in claim 19, wherein said signal reception by the signal receiving means is performed every time the time information counted by the time counting means has passed a predetermined time period.

21. An electronic timepiece having a signal receiving function as claimed in claim 19, further comprising:

display means for displaying the date and time information about the signal receiving point obtained by said time controlling means.

22. An electronic timepiece having a signal receiving function as claimed in claim 19, further comprising:

receiving-position information display means for displaying the regional information about the signal receiving point, which has been calculated by said receiving-position calculating means.

23. An electronic timepiece having a signal receiving function as claimed in claim 19, wherein said plurality of satellites are satellites used in the Global Positioning System.

24. An electronic timepiece having a signal receiving function as claimed in claim 19, wherein:

the time counting operation by said time counting means is performed in response to a first clock signal derived from a first oscillating means; and the signal reception by said signal receiving means is executed in response to a clock signal having a frequency higher than that of said first clock signal.

* * * * *